US011392065B2

(12) United States Patent
Kondo

(10) Patent No.: US 11,392,065 B2
(45) Date of Patent: Jul. 19, 2022

(54) FIXING DEVICE AND IMAGE FORMING APPARATUS INCLUDING THE FIXING DEVICE

(71) Applicant: KYOCERA Document Solutions Inc., Osaka (JP)

(72) Inventor: Akihiro Kondo, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/343,608

(22) Filed: Jun. 9, 2021

(65) Prior Publication Data

US 2021/0389703 A1 Dec. 16, 2021

(30) Foreign Application Priority Data

Jun. 15, 2020 (JP) ..... JP2020-102824

(51) Int. Cl.
*G03G 15/20* (2006.01)

(52) U.S. Cl.
CPC ..... *G03G 15/2039* (2013.01)

(58) Field of Classification Search
CPC ..... G03G 15/2039
See application file for complete search history.

(56) References Cited

U.S. PATENT DOCUMENTS

2006/0062585 A1* 3/2006 Sone ..... G03G 15/2039 399/69
2013/0251390 A1* 9/2013 Ishii ..... G03G 15/205 399/67

FOREIGN PATENT DOCUMENTS

JP 2002-311744 A 10/2002
JP 2008-298877 A 12/2008

* cited by examiner

*Primary Examiner* — Clayton E. LaBalle
*Assistant Examiner* — Michael A Harrison
(74) *Attorney, Agent, or Firm* — Studebaker & Brackett PC

(57) ABSTRACT

A fixing device includes a heated rotational body, a heating unit, a pressing rotational body, a drive unit, a light emitting unit, a light receiving unit, and a drive control part. The heated rotational body has a reflection member. The drive unit rotates the pressing rotational body. The light emitting unit emits infrared light. The light receiving unit receives the infrared light reflected on the reflection member, and receives radiation light of the heated rotational body. The light receiving unit detects a temperature of the heated rotational body based on a receiving of the radiation light. The drive control part obtains a rotational speed of the heated rotational body based on a light receiving period of the infrared light in the light receiving unit and a circumference determined depending on the temperature of the heated rotational body, and controls the drive unit based on the obtained rotational speed.

9 Claims, 7 Drawing Sheets

FIXING DEVICE AND IMAGE FORMING APPARATUS INCLUDING THE FIXING DEVICE

INCORPORATION BY REFERENCE

This application is based on and claims the benefit of priority from Japanese patent application No. 2020-102824 filed on Jun. 15, 2020, which is incorporated by reference in its entirety.

BACKGROUND

The present disclosure relates to a fixing device used for an image forming apparatus such a copying machine, a printer, a facsimile and a multifunctional peripheral and an image forming apparatus including the fixing device.

In an image forming apparatus such as a copying machine, a fixing device is widely used. The fixing device melts and fixes an unfixed toner image on a sheet, as a recording medium, by heating and pressing. As such a fixing device, for example, a configuration is known, in which an endless fixing belt to be heated (a heated rotational body) and a pressing roller (a pressing rotational body) come pressure contact with each other to form a fixing nip area, and the unfixed toner image is fixed on the sheet at the fixing nip area.

By the way, the fixing belt expands due to the heating. When the fixing belt thermally expands, a circumference of the fixing belt becomes longer than a reference circumference. In this case, if a rotational speed of the fixing belt is obtained by a period required for one rotation of the fixing belt and a predetermined circumference of the fixing belt, the obtained rotational speed contains a tolerance of variation in the circumference due to the thermal expansion of the fixing belt. Then, in a case where a rotational speed of the pressing roller coming into pressure contact with the fixing belt is adjusted based on the rotational speed of the fixing belt, it becomes difficult to perform the adjustment with high accuracy. Accordingly, in order to adjust the rotational speed of the pressing roller correctly, it is required to obtain the correct rotational speed of the fixing belt in view of the thermal expansion of the fixing belt. However, a technique for obtaining the correct rotational speed of the fixing belt is not disclosed.

SUMMARY

In accordance with an aspect of the present disclosure, a fixing device includes a heated rotational body, a heating unit, a pressing rotational body, a drive unit, a light emitting unit, a light receiving unit, and a drive control part. The heated rotational body has a reflection member on a portion in a circumferential direction. The heating unit heats the heated rotational body. The pressing rotational body comes into pressure contact with the heated rotational body, and a fixing nip area where an unfixed toner image on a recording medium is melted and fixed is formed between the pressing rotational body and the heated rotational body. The drive unit rotates the pressing rotational body. The light emitting unit emits infrared light toward the heated rotational body. The light receiving unit receives the infrared light emitted from the light emitting unit and reflected on the reflection member of the heated rotational body periodically when the heated rotational body is rotated, and receives radiation light generated by a heating of the heated rotational body. The drive control part is configured to control the drive unit based on a detection result of the light receiving unit. The light receiving unit detects a temperature of the heated rotational body based on a receiving of the radiation light. The drive control part obtains a rotational speed of the heated rotational body based on a light receiving period of the infrared light in the light receiving unit and a circumference determined depending on the temperature of the heated rotational body, and controls the drive unit based on the obtained rotational speed.

In accordance with an aspect of the present disclosure, an image forming apparatus includes the fixing device, and an image forming unit for forming the unfixed toner image on the recording medium to be conveyed to the fixing device.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
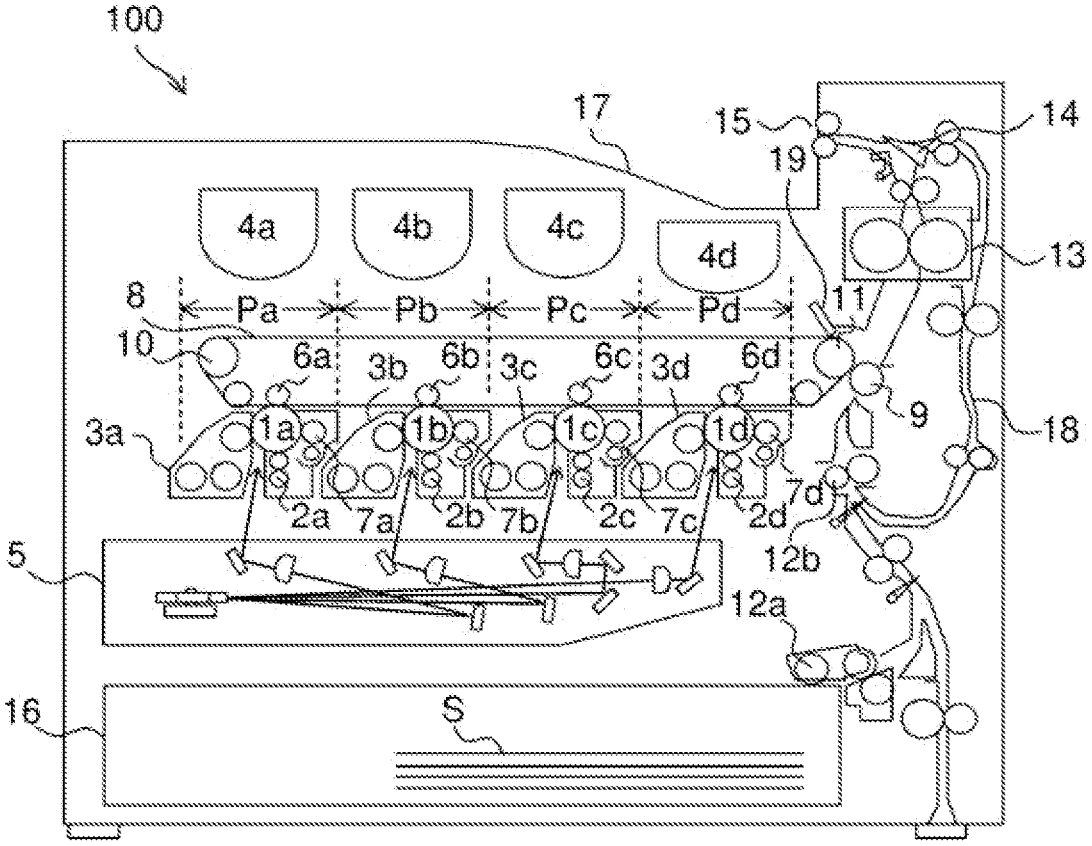
FIG. 1 is a sectional view schematically showing an inner structure of an image forming apparatus including a fixing device according to one embodiment of the present disclosure.

[Structure of Image Forming Apparatus] Hereinafter, with reference to the attached drawings, one embodiment in the present disclosure will be described. FIG. 1 is a sectional view schematically showing an inner structure of an image forming apparatus 100 including a fixing device 13 according to the embodiment of the present disclosure. In a main body of the image forming apparatus 100 (for example, a color printer in the embodiment), four image forming sections Pa, Pb, Pc and Pd are disposed in order along one direction (in a direction from the left side to the right side in FIG. 1). These image forming sections Pa to Pd are provided corresponding to images of different four colors (cyan, magenta, yellow and black), and form cyan, magenta, yellow and black images in order by charging processing, exposure processing, development processing and transferring processing.

These image forming sections Pa to Pd include photosensitive drums (an image carrier) 1*a*, 1*b*, 1*c* and 1*d* on which a visible image (a toner image) of each color is carried. Further, an intermediate transferring belt 8 traveling in the counterclockwise direction in FIG. 1 is provided adjacent to the image forming sections Pa to Pd. The toner images formed on the photosensitive drums 1*a* to 1*d* are primarily transferred in order and overlapped on the intermediate transferring belt 8 traveling while coming into contact with the photosensitive drums 1*a* to 1*d*. After that, the toner images primarily transferred on the intermediate transferring belt 8 are secondarily transferred on a sheet S, as an example of a recording medium, by a second transferring roller 9. The sheet S is discharged from the main body of the image forming apparatus 100 after the toner image is fixed in the fixing device 13. The image forming processing for the photosensitive drums 1*a* to 1*d* is carried out as the photosensitive drums 1*a* to 1*d* are rotated in the clockwise direction in FIG. 1 by a main motor (not shown).

The sheet S on which the toner image is secondarily transferred is stored in a sheet feeding cassette 16 disposed in the lower portion of the main body of the image forming apparatus 100. The sheet S in the sheet feeding cassette 16 is conveyed to a nip area between the second transferring roller 9 and a drive roller 11 for driving the intermediate transferring belt 8 by a sheet feeding roller 12*a* and a resist rollers pair 12*b*. As the intermediate transferring belt 8, an endless (seamless) belt made of dielectric resin sheet is used conventionally. On a downstream side of the second transferring roller 9, a blade shaped belt cleaner 19 is disposed so as to remove the toner remaining on the surface of the intermediate transferring belt 8.

Next, the image forming sections Pa to Pd will be described. Around and below the rotatable photosensitive drums 1*a* to 1*d*, charging devices 2*a*, 2*b*, 2*c* and 2*d*, an exposure device 5, development devices 3*a*, 3*b*, 3*c* and 3*d*, and cleaning devices 7*a*, 7*b*, 7*c* and 7*d* are provided. The charging devices 2*a* to 2*d* charge the photosensitive drums 1*a* to 1*d*. The exposure device 5 exposes the photosensitive drums 1*a* to 1*d* based on an image data. The development devices 3*a* to 3*d* form the toner images on the photosensitive drums 1*a* to 1*d*. The cleaning devices 7*a* to 7*d* remove the developer (the toner) and the other remaining on the photosensitive drums 1*a* to 1*d*.

When the image data is input from a host device such as a personal computer, first, the surfaces of the photosensitive drums 1*a* and 1*d* are uniformly charged by the charging devices 2*a* to 2*d*. Secondary, the surfaces of the photosensitive drums 1*a* to 1*d* are exposed with light emitted from the exposure device 5 based on the image data. Then, electrostatic latent images based on the image data are formed on the photosensitive drums 1*a* to 1*d*. The development devices 3*a* to 3*d* are filled with a predetermined amount of the developer (for example, a two-component developer) containing the cyan, magenta, yellow and black toner. The toner in the developer is supplied to the photosensitive drums 1*a* to 1*d* by the development devices 3*a* to 3*d* and electrostatically attracted to the photosensitive drums 1*a* to 1*d*. Thus, the toner images corresponding to the electrostatic latent images formed by the exposing of the exposure device 5 are formed. When a rate of the toner in the two-component developer filled in each of the development devices 3*a* to 3*d* becomes less than a specified rate owing to the above toner image formation, the toner is replenished to the corresponding development device of the development devices 3*a* to 3*d* from the corresponding toner container of the toner containers 4*a* to 4*d*.

When the primary transferring rollers 6*a* to 6*d* apply an electric field at a predetermined transferring voltage between the primary transferring rollers 6*a* to 6*d* and the photosensitive drums 1*a* to 1*d*, the cyan, magenta, yellow and black toner images on the photosensitive drums 1*a* to 1*d* are primarily transferred on the intermediate transfer belt 8. These four color images are formed with a predetermined positional relationship predetermined for forming a predetermined full-color image. Thereafter, in preparation to form a new electrostatic latent image subsequently, the toner and the others remaining on the surfaces of the photosensitive drums 1*a* to 1*d* after the primary transferring are removed by the cleaning devices 7*a* to 7*d*.

The intermediate transferring belt 8 is wound between an upstream driven roller 10 and the downstream drive roller 11. When the intermediate transferring belt 8 starts to travel in the counterclockwise direction as the drive roller 11 is rotated by a belt drive motor (not shown), the sheet S is conveyed from the resist rollers pair 12*b* to the nip area (a secondary transferring nip area) between the drive roller 11 and the secondary transferring roller 9 at a predetermined timing. In the nip area, the full-color image on the intermediate transferring belt 8 is secondarily transferred on the sheet S. The sheet S on which the toner image is secondarily transferred is conveyed to the fixing device 13.

Figure 2:
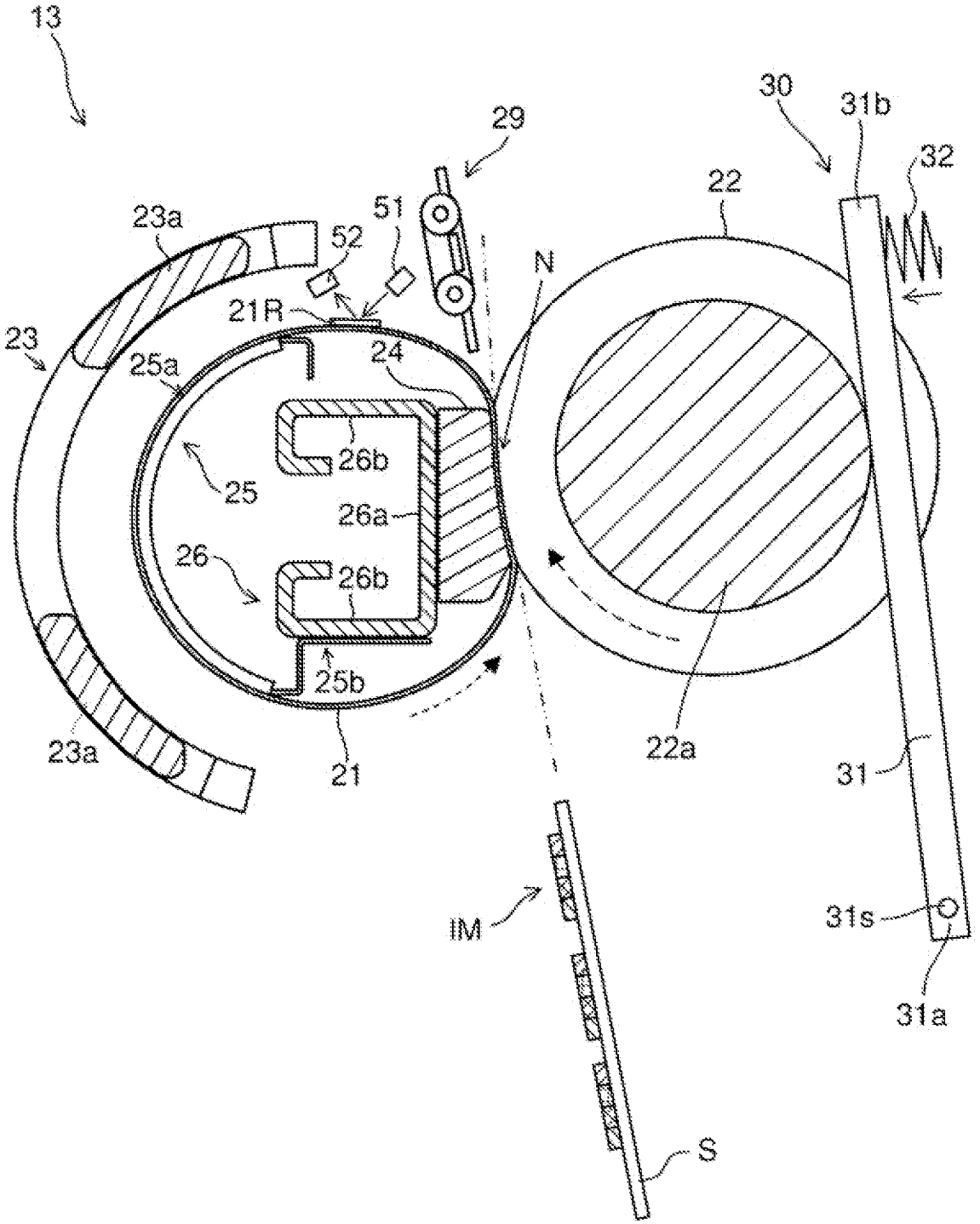
FIG. 2 is a sectional view schematically showing a structure of the fixing device.

The sheet S conveyed to the fixing device 13 is heated and pressed by a fixing belt 21 and a pressing roller 22 (see FIG. 2). Thus, the toner image is fixed to the surface of the sheet S, and the predetermined full-color image is formed. The conveyance path of the sheet S on which the full-color image is formed is branched at a branch portion 14 branched in a plurality of directions, and is discharged to a discharge tray 17 by a discharge roller pair 15 as it is (alternatively, after the sheet is fed to a double-sided conveying path 18 and the images are formed on both sides).

[2. Structure of Fixing Device] FIG. 2 is a sectional view schematically showing a structure of the fixing device 13. The upper side of FIG. 2 shows a downstream side in a sheet passing direction (a conveyance direction) for the fixing device 13, and the lower side of FIG. 2 shows an upstream side in the sheet passing direction for the fixing device 13. The fixing device 13 includes the fixing belt 21 (a heated rotational body), the pressing roller 22 (a pressing rotational body), a heating unit 23, a nip formation member 24, a belt guide 25 and a frame member 26.

The fixing belt 21 is supported by a housing (not shown) of the fixing device 13 in a rotatable manner around a horizontal axis. The fixing belt 21 is formed into an endless cylindrical shape having an outer diameter of 20 mm to 50 mm, for example. The fixing belt 21 has an axial length (a length in a width direction of the sheet S) almost equal to an axial length of the pressing roller 22. The fixing belt 21 rotates in the counterclockwise direction in FIG. 2 along the conveyance direction of the sheet S, as a recording medium. The rotational direction of the fixing belt 21 is also called a circumferential direction.

Figure 3:
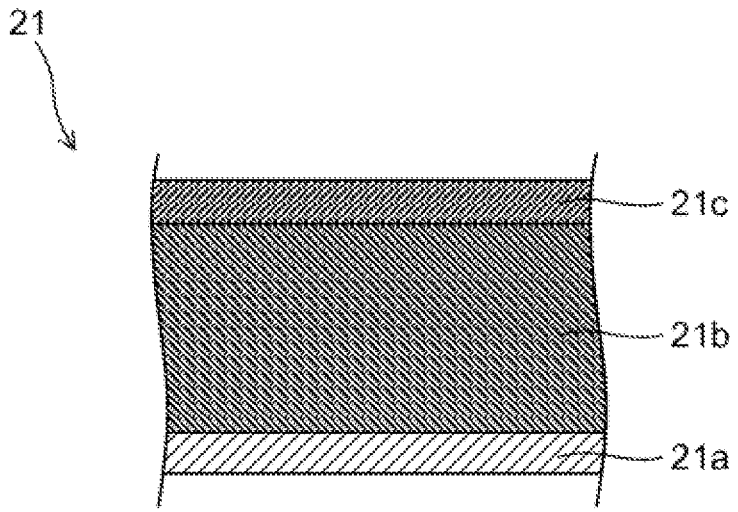
FIG. 3 is a sectional view schematically showing a fixing belt of the fixing device.

FIG. 3 is a sectional view schematically showing a structure of the fixing belt 21. The fixing belt 21 has a layered structure having a heating layer 21*a* as a base layer, an elastic layer 21*b* and a release layer 21*c* which are provided around the heating layer 21*a* in order from the inside. The heating layer 21*a* is made of a metal film, such as a nickel film, having a thickness of 30 μm to 50 μm, or a polyimide film mixed with metal powder, such as copper, silver and aluminum, and having a thickness of 50 μm to 100 μm, for example. The elastic layer 21*b* is made of silicon rubber, and has a thickness of 100 μm to 500 μm, for example. The release layer 21*c* is made of fluorine-based resin, such as PFA (tetrafluoroethylene-perfluoroalkyl vinyl ether copolymer), and has a thickness of 30 μm to 50 μm, for example.

The fixing belt 21 includes a reflection member 21R shown in FIG. 2. The reflection member 21R is made of aluminum foil, for example, and is provided on the outer circumferential face (for example, on the release layer 21*c*)

of the fixing belt 21 at an end portion in the axial direction of the fixing belt 21 (in the belt width direction, a direction perpendicular to the circumferential direction). In the circumferential direction of the fixing belt 21, the reflection member 21R is provided on a portion in the circumferential direction. The reflection member 21R reflects infrared light emitted from a light emitting unit 51 on a light receiving unit 52, described later.

The pressing roller 22 is supported by the housing of the fixing device 13 in a rotatable manner around a horizontal rotational axis. The pressing roller 22 is formed into a column shape, and has an axial length (a length in the sheet width direction) almost equal to the fixing belt 21.

The pressing roller 22 has a layered structure having a core metal 22*a*, an elastic layer and a release layer provided around the core metal 22*a* in order. The core metal 22*a* is made of metal, such as aluminum, and has a diameter of 20 mm, for example. The core metal 22*a* has an axial length longer than that of the elastic layer and the release layer. The elastic layer is made of silicon rubber, and has a thickness of 8 mm, for example. The release layer is made of fluorine-based resin, and has a thickness of 10 μm to 50 μm, for example.

A predetermined pressure is applied to the pressing roller 22 toward the fixing belt 21 by a pressing mechanism 30. The outer circumferential face of the pressing roller 22 is pressed on the nip formation member 24 across the fixing belt 21, and comes into pressure contact with the outer circumferential face of the fixing belt 21. Then, between the outer circumferential faces, the fixing nip area N is formed. That is, the pressing roller 22 comes into pressure contact with the fixing belt 21, and the fixing nip area N where an unfixed toner image IM on the sheet S is melt and fixed is formed between the pressing roller 22 and the fixing belt 21.

The pressing mechanism 30 includes a rod-shaped pressing lever 31 and a pressing spring 32. The pressing levers 31 are provided in the axial end portions of a supporting shaft 31*s*. The supporting shaft 31*s* extends in parallel to the rotational axis of the pressing roller 22 (the central axis of the core metal 22*a*), and is disposed separated away from the pressing roller 22. One end portion 31*a* of the pressing lever 31 (the lower end portion in FIG. 2) is connected to the supporting shaft 31*s*. Then, the pressing lever 31 is turnable around the supporting shaft 31*s*. The pressing lever 31 comes into contact with the core metal 22*a* between the one end portion 31*a* and the other end portion 31*b* (the upper end portion in FIG. 2).

The pressing spring 32 is a biasing member which presses the other end portion 31*b* of the pressing lever 31 to bias the pressing lever 31 toward the core metal 22*a*. By the biasing force of the pressing spring 32, the pressing lever 31 turns in the counterclockwise direction in FIG. 2 around the supporting shaft 31*s*. This makes it possible to press the pressing roller 22 on the fixing belt 21.

The pressing roller 22 rotates in the clockwise direction in FIG. 2 by a drive unit 41 (see FIG. 4) described later. The pressing roller 22 comes into contact with the outer circumferential face of the fixing belt 21, and applies a rotational drive force in the counterclockwise direction to the fixing belt 21. This makes it possible to drive the fixing belt 21 to be rotated.

The heating unit 23 is disposed on an area opposite to an area where the pressing roller 22 is disposed, with respect to the fixing belt 21, and faces the outer circumferential face of the fixing belt 21 via a predetermined gap. The heating unit 23 extends along the axial direction of the fixing belt 21 slightly longer than the fixing belt 21. The heating unit 23 applies heat to the heating layer 21*a* of the fixing belt 21 in an introduction heating manner, and heats the fixing belt 21.

The heating unit 23 includes an excitation coil 23*a*, a holder, a core (which are not shown) and the others. The excitation coil 23*a* and the core are held by the holder at a predetermined position. The excitation coil 23*a* is made of a litz wire made of conductive wires bundle, and is wound so as to extend along the axial direction of the fixing belt 21. The excitation coil 23*a* is formed into an arc shape around the outer circumferential face of the fixing belt 21 along the circumferential direction of the fixing belt 21.

The nip formation member 24 is disposed inside the fixing belt 21 so as to face the pressing roller 22 across the fixing belt 21. The nip formation member 24 comes into contact with the inner circumferential face of the fixing belt 21, and forms the fixing nip area N between the fixing belt 21 and the pressing roller 22.

The nip formation member 24 has an approximately parallelepiped shape extending in the axial direction of the fixing belt 21 and having a length almost equal to the length of the fixing belt 21. The nip formation member 24 has a base material made of metal such as aluminum, or heat resistant resin such as liquid crystal polymer, for example. The nip formation member 24 may have an elastic layer made of elastomer or silicon rubber, for example, on the surface facing the fixing belt 21. The nip formation member 24 has a sheet member (a release layer) made of fluorine-based resin, such as PFA, on the face facing the fixing belt 21. The nip formation member 24 has a sheet member (a release layer) made of fluorine-based resin, such as PFA, for example, on the surface facing the fixing belt 21. The sheet member comes into contact with the inner circumferential face of the fixing belt 21 at the fixing nip area N, and extends in the upstream area and in the downstream area in the rotational direction of the fixing belt 21 from the fixing nip area N, with which the fixing belt 21 does not come into contact.

The belt guide 25 is disposed in the inside of the fixing belt 21 so as to face the heating unit 23 across the fixing belt 21. The belt guide 25 comes into contact with the inner circumferential face of the fixing belt 21 other than the fixing nip area N, and supports the fixing belt 21 from the inside. The belt guide 25 is formed by a metal plate having a length almost equal to the fixing belt 21 in the axial direction of the fixing belt 21. The belt guide 25 is made of magnetic elastic metal, such as SUS430, and has a thickness of 0.1 mm to 0.5 mm, for example. The belt guide 25 has a contact part 25*a* and a connection part 25*b*.

The contact part 25*a* is disposed on an opposite side to the fixing nip area N with respect to a radial center of the fixing belt 21. The contact part 25*a* is curved in an arc shape along the inner circumferential face of the fixing belt 21. The contact part 25*a* comes into contact with the inner circumferential face of the fixing belt 21 with almost its outer circumferential face. The contact part 25*a* faces the excitation coil 23*a* across the fixing belt 21.

The connection part 25*b* is disposed on the downstream side of the contact part 25*a* in the rotational direction of the fixing belt 21. The connection part 25*b* is coupled to a circumferential end portion of the contact part 25*a*. The connection part 25*b* bents from the circumferential end portion of the contact part 25*a* inward radially, and then bents toward the fixing nip area N adjacently the frame member 26. The connection part 25*b* does not come into contact with the fixing belt 21.

The frame member 26 is disposed in almost the radial center portion of the fixing belt 21 between the contact part

25*a* of the belt guide 25 and the nip formation member 24. The frame member 26 extends slightly longer than the fixing belt 21 along the axial direction of the fixing belt 21.

The frame member 26 holds the nip formation member 24 and the belt guide 25. The nip formation member 24 is fixed to a nip side wall portion 26*a* of the frame member 26 facing the fixing nip area N. The connection part 25*b* of the belt guide 25 is fixed to a side wall portion 26*b* of the frame member 26 on the upstream side of the rotational direction of the fixing belt 21.

On the downstream side (the upper side in FIG. 2) of the fixing nip area N in the sheet conveyance direction, a separator 29 is disposed. The separator 29 separates the sheet S passed through the fixing nip area N from the outer circumferential face of the fixing belt 21.

Figure 4:
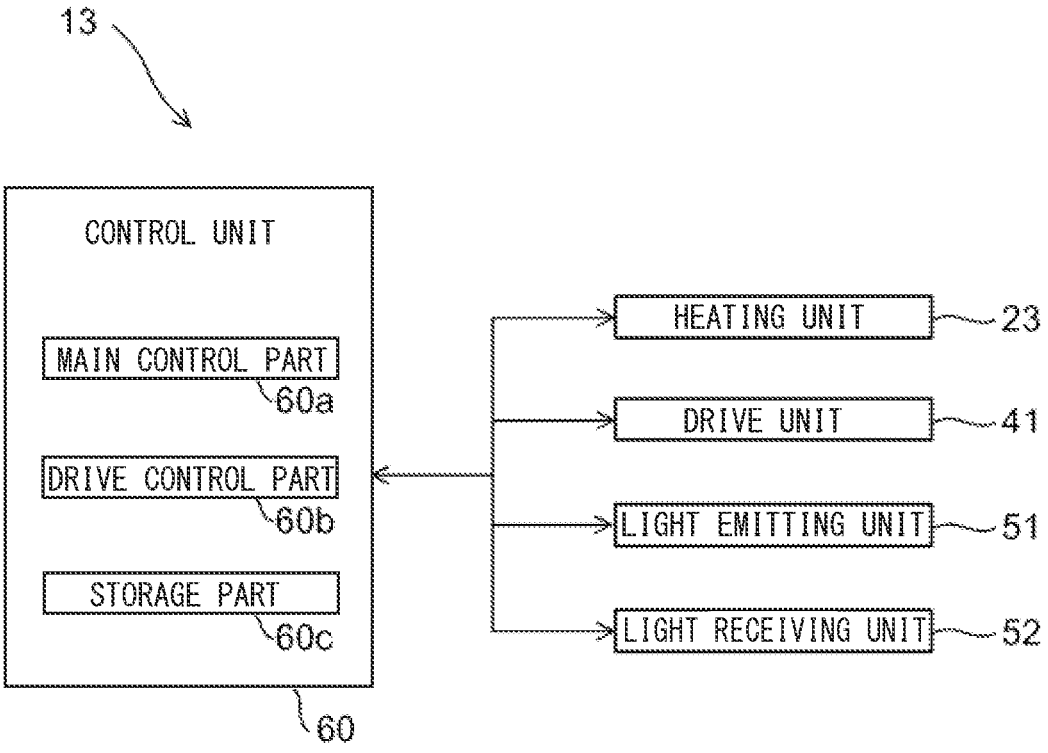
FIG. 4 is a block diagram schematically showing a control system of the fixing device.

[3. Control System of Fixing Device] FIG. 4 is a block diagram schematically showing a configuration of a control system of the fixing device 13. The fixing device 13 includes the drive unit 41, a light emitting unit 51, a light receiving unit 52 and a control unit 60, in addition to the above-described configuration. The drive unit 41 includes a motor, a gear train and the others, and drives the pressing roller 22 to rotate it. The pressing roller 22 is rotated with a drive force from the motor.

The light emitting unit 51 is a light source for emitting infrared light (infrared ray) toward the fixing belt 21, and is constituted of, for example, an LED (a light emitting diode) or a laser light source for emitting the infrared light. In the present embodiment, the light emitting unit 51 is controlled by a main control part 60*a*, described later, of the control unit 60 so as to emit the infrared light at a constant period.

The light receiving unit 52 receives the infrared light emitted from the light emitting unit 51 and reflected on the reflection member 21R of the fixing belt 21 periodically owing to the rotation of the fixing belt 21, and also receives radiation light generated by heat generation of the fixing belt 21 (heat generated by the heating unit 23). In particular, the light receiving unit 52 detects a temperature of the fixing belt 21 by receiving the radiation light from the fixing belt 21. The light receiving unit 52 is constituted of an infrared sensor having sensitivity in both wavelength ranges of the infrared light and the radiation light. In the present embodiment, the light emitting unit 51 and the light receiving unit 52 are disposed on the downstream side of the fixing nip area N around the fixing belt 21 (see FIG. 2), but may be disposed on the upstream side.

The control unit 60 includes, for example, a central processing unit (CPU) and a memory. Specifically, the control unit 60 includes the main control part 60*a*, a drive control part 60*b*, and a storage part 60*c*.

The main control part 60*a* controls the operations of the fixing device 13 and other parts of the image forming apparatus 100. The main control part 60*a* controls the heating unit 23 based on the temperature of the fixing belt 21 detected by the light receiving unit 52. This makes it possible to control the temperature of the fixing belt 21 within a predetermined temperature range suitable for the fixing.

The drive control part 60*b* controls the drive unit 41 based on the detection result by the light receiving unit 52 to control the rotation of the pressing roller 22. Thus, the rotation of the fixing belt 21 rotated by being driven by the rotation of the pressing roller 22 can be indirectly controlled. The rotation control of the fixing belt 21 by the drive control of the drive unit 41 will be described later in detail.

The storage part 60*c* is a memory for storing an operation program of the control unit 60 and various kinds of information, and includes a ROM (a Read Only Memory), a RAM (a Random Access Memory), a nonvolatile memory, and the like. In particular, the storage part 60*c* stores a table showing a relationship between the temperature of the fixing belt 21 and the circumference (the circumferential length) of the fixing belt 21.

Figure 5:
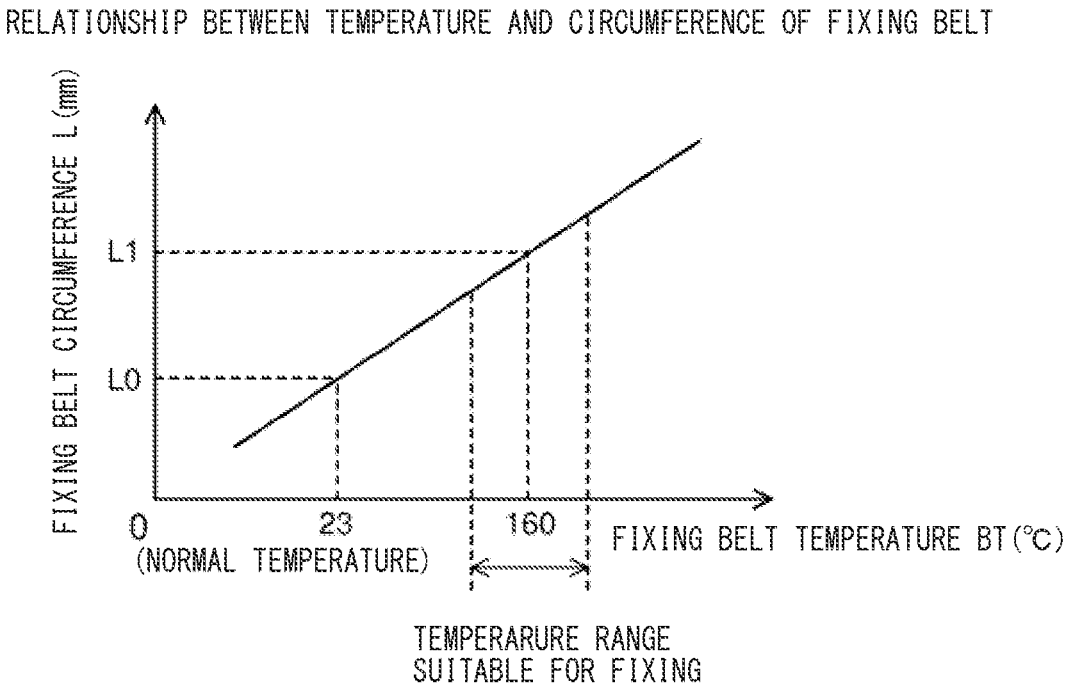
FIG. 5 is a graph showing a relationship between a temperature and a circumference of the fixing belt.

FIG. 5 is a graph showing the relationship between the temperature BT (° C.) of the fixing belt 21 and the circumference L (mm) of the fixing belt 21. As shown in FIG. 5, the circumference L of the fixing belt 21 changes in accordance with a change in the temperature BT of the fixing belt 21. For example, when the temperature BT of the fixing belt 21 increases from a normal temperature (for example, 23° C.) to a temperature necessary for the fixing (for example, 160° C.), the circumference L of the fixing belt 21 extends from L0 (mm) to L1 (mm) due to the thermal expansion of the fixing belt 21. The relationship between the temperature BT of the fixing belt 21 and the circumference L of the fixing belt 21 varies depending on the layer structure, the material forming each layer, and the others of the fixing belt 21 to be used. The relationship between the temperature BT and the circumference L, specific to the fixing belt 21 to be used is stored in the storage part 60*b* in a table state.

Figure 6:
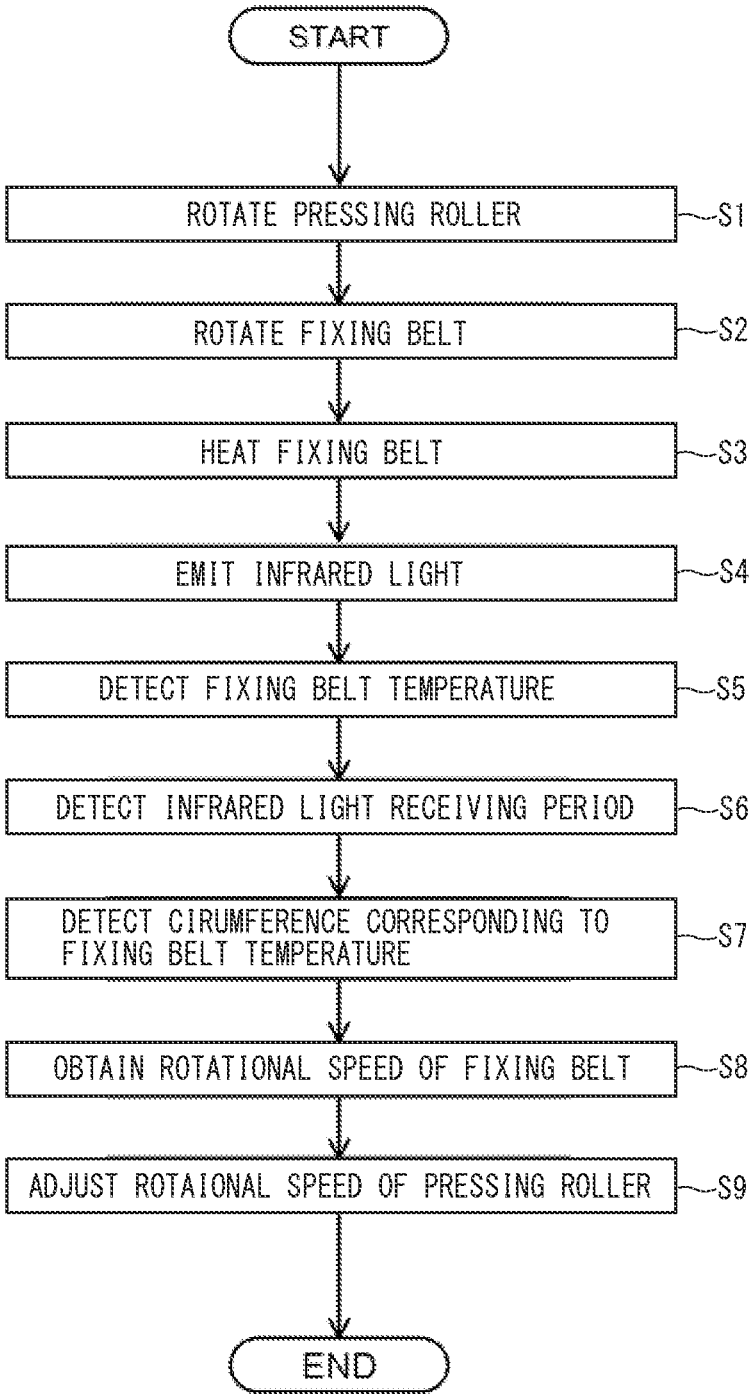
FIG. 6 is a flow chart showing an operation for controlling a rotation of the fixing belt.
Figure 7:
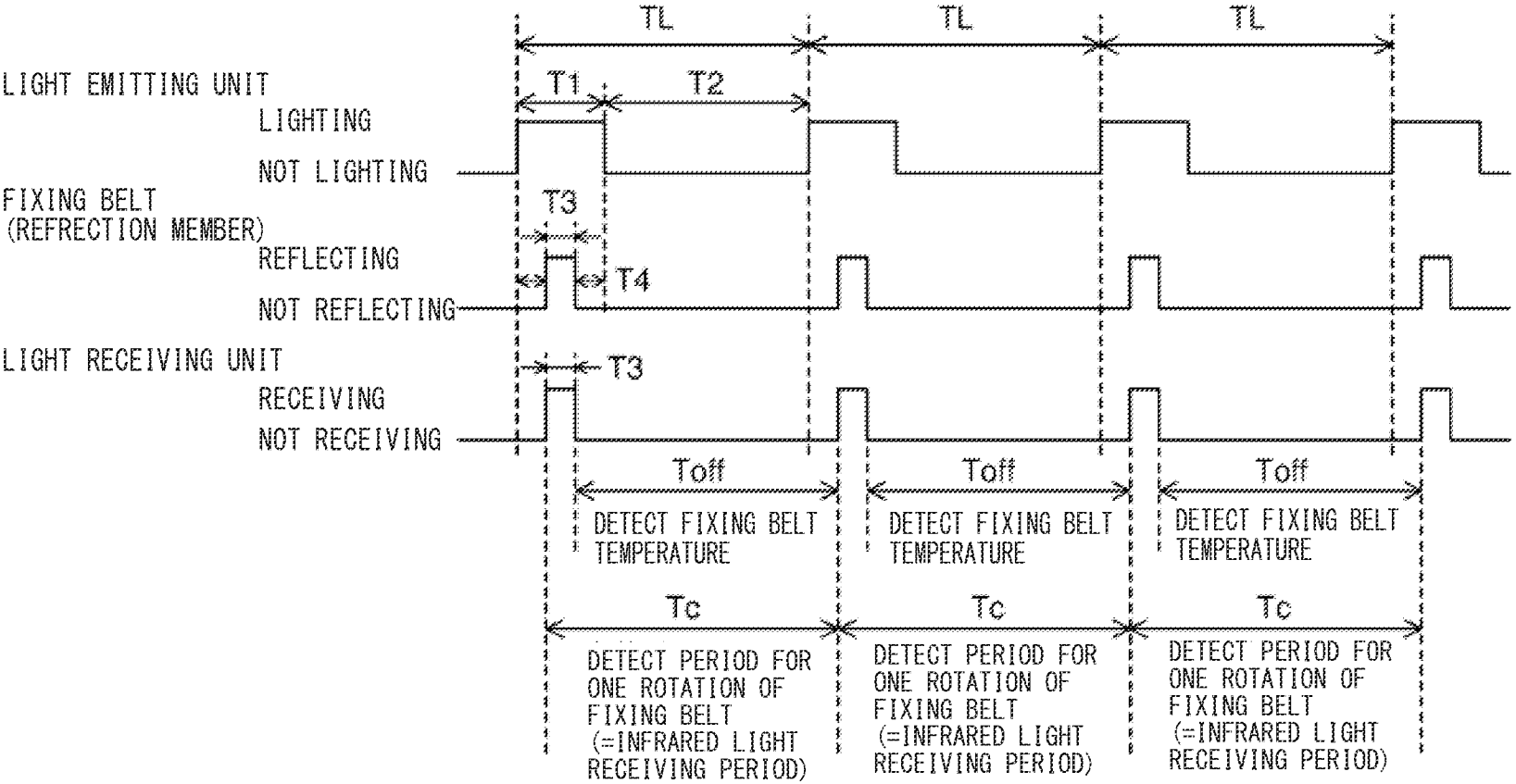
FIG. 7 is a timing chart schematically showing an example of timings of reflection of infrared light on a reflection member of the fixing belt and reception of the infrared light by a reception part.

[4. Rotation Control of Fixing Belt] Next, the rotation control of the fixing belt 21 in the present embodiment will be described. FIG. 6 is a flowchart showing an operation for controlling the rotation of the fixing belt 21. FIG. 7 is a timing chart schematically showing an example of the timings of the emitting of infrared light in the light emitting unit 51, the reflecting of the infrared light on the reflecting member 21R of the fixing belt 21, and the receiving of the infrared light in the light receiving unit 52.

First, the drive control part 60*b* (see FIG. 4) of the control unit 60 controls the drive unit 41 to rotate the pressing roller 22 in the clockwise direction in FIG. 2 (S1). As a result, the fixing belt 21 on which the pressure roller 22 is pressed rotates in the counterclockwise direction in FIG. 2 (S2). A timing at which the drive control part 60*b* starts the rotation of the pressure roller 22 is appropriately controlled at a timing determined in accordance with the image forming operation in the image forming sections Pa to Pd.

Next, the main control part 60*a* controls the heating unit 23 to heat the heat generating layer 21*a* of the fixing belt 21, and heats the fixing belt 21 to a predetermined temperature (for example, 160° C.) (S3). The fixing belt 21 may be heated in parallel with S2 or before the pressing roller 22 is rotated in S1.

Next, the main control part 60*a* of the control unit 60 controls the light emitting unit 51 to perform an emitting of the infrared light and a stopping of the emitting of the infrared light (S4). By this control, the light emitting unit 51 performs the emitting of the infrared light and the stopping of the emitting of the infrared light within a prescribed period TL (sec) shown in FIG. 7, and repeats the emitting of the infrared light and the stopping of the emitting of the infrared light at the period TL. When a period in which the light emitting unit 51 emits the infrared light within the above period TL is set to a light emitting period T1 (sec) and a period in which the light emitting unit 51 stops the emitting of the infrared light within the above period TL is set to a light emitting stop period T2 (sec), TL=T1+T2. The light emitting timing of the infrared light in the light emitting unit 51 is controlled such that a period T3 (sec), described later, in which the infrared light is reflected on the reflection member 21R of the fixing belt 21 and then received by the light receiving unit 52 is contained within the light emitting period T1.

Next, the light receiving unit 52 detects the temperature BT of the fixing belt 21 (S5). More specifically, it is as follows.

The infrared light emitted from the light emitting unit 51 advances toward the fixing belt 21 and is emitted on the fixing belt 21. In the period T3 in which the infrared light is emitted on the reflection member 21R circulating with the rotation of the fixing belt 21, of the light emitting period T1 in which the infrared light is emitted from the light emitting unit 51, the infrared light is reflected on the reflection member 21R toward the light receiving unit 52, and then received by the light receiving unit 52. Therefore, the period T3 constitutes an infrared light receiving period when the light receiving unit 52 periodically receives the infrared light emitted from the light emitting unit 51 via the reflection member 21R. Hereinafter, the period T3 is also called the infrared light receiving period T3.

On the other hand, in a period T4 (=T1−T3) in which the infrared light is emitted on a portion other than the reflection member R as the fixing belt 21 is rotated, of the light emitting period T1, the infrared light is not received by the light receiving unit 52 because it is not reflected on the reflection member 21R. Further, in the light emitting stop period T2, because the infrared light is not emitted from the light emitting unit 51, the infrared light is not received by the light receiving unit 52. Therefore, the light emitting stop period T2 and the period T4 constitutes a period in which the infrared light emitted from the light emitting unit 51 is not received. Hereinafter, a total period of the light emitting stop period T2 and the period T4 is called a non-infrared light receiving period Toff (sec) (Toff=T2+T4).

In the non-infrared light receiving period Toff, infrared light generated by the heating of the fixing belt 21 is radiated from the fixing belt 21. The above infrared light generated by the heating of the fixing belt 21 is called a radiation light in order to separate it from the infrared light emitted from the light emitting unit 51. In the non-infrared light receiving period Toff, the radiation light radiated from the fixing belt 21 is only received by the light receiving unit 52. Then, the light receiving unit 52 makes it possible to detect the temperature BT of the fixing belt 21 based on the receiving of the radiation light in the non-infrared light receiving period Toff.

However, in the infrared light receiving period T3, the reception belt 21 radiates the radiation light due to the heating, and the light receiving unit 52 receives the radiation light. Then, an amount of the light detected by the light receiving unit 52 in the infrared light receiving period T3 is an amount of the above radiation light added with an amount of the infrared light received via the reflection member 21R from the light emitting unit 51. Therefore, the light receiving unit 52 allows to separate the infrared light receiving period T3 in which both the infrared light and the radiation light are received from the non-infrared light receiving period Toff where the above radiation light is only received, based on the amount of the detected light. Then, the light receiving unit 52 allows to detect the temperature BT of the fixing belt 21 based on the amount of the radiation light detected in the non-infrared light receiving period Toff.

Next, the drive control part 60*b* detects a light receiving period Tc (sec) of the infrared light when the fixing belt 21 is rotated, that is a period required for one rotation of the fixing belt 21, based on the receiving of the infrared light by the light receiving unit 52 (S6). As described above, the light receiving unit 52 allows to separate the infrared light receiving period T3 from the non-infrared light receiving period Toff in which the infrared light is not received while the radiation light is only received. Then, the drive control part 60*b* allows to obtain the light receiving period Tc of the infrared light based on a light receiving starting timing of the infrared light in the infrared light receiving period Tc of the light receiving unit 52.

Next, the drive control part 60*b* obtains a circumference L corresponding to the temperature BT of the fixing belt 21 detected in S5, based on the table stored in the storage part 60*c* (S7). Then, the drive control part 60*b* obtains a rotational speed V (mm/sec) of the fixing belt 21 based on the light receiving period Tc of the infrared light and the circumference L of the fixing belt 21 obtained in S7 (S8). For example, the rotational speed V of the fixing belt is obtained by L/Tc.

Then, the drive control part 60*b* controls the drive unit 41 (for example, a motor) based on the rotational speed V of the fixing belt 21 obtained in S8 to adjust a rotational speed of the pressing roller 22 (S9). For example, when it is determined that the rotational speed V of the fixing belt 21 is faster than a predetermined speed range due to the thermal expansion of the fixing belt 21, the drive control part 60*b* controls the drive unit 41 to decrease the rotational speed of the pressing roller 22 such that the sheet S is conveyed at a conveyance speed within the predetermined range.

As described above, in the fixing device 13 in the present embodiment, the light receiving unit 52 detects the temperature BT of the fixing belt 21 by the receiving of the radiation light generated by the heating of the heating belt 21 (S5). Therefore, even if the fixing belt 21 is heat-expanded, the drive control part 60*b* allows to obtain the circumference L corresponding to the temperature BT at the heat-expansion (S7). That is, it becomes possible to obtain the circumference L (a standard circumference+an extended length due to the heat-expansion) at the heat-expansion. Then, the drive control part 60*b* obtains the rotational speed V of the fixing belt 21 based on the light receiving period Tc in which the infrared light emitted from the light emitting unit 51 is received by the light receiving unit 52 and the above circumference L of the fixing belt 21 (S8). As described above, because the circumference L of the fixing belt 21 is obtained in consideration of a variation in length due to the heat-expansion of the fixing belt 21, it becomes possible to obtain the rotational speed V of the fixing belt 21 correctly based on the light receiving period Tc and the above circumference L.

Accordingly, the drive control part 60*b* controls the drive unit 41 based on the obtained rotational speed V, and it becomes possible to adjust the rotational speed of the pressing roller 22 coming into pressure contact with the fixing belt 21 with high accuracy. As a result, it becomes possible to keep the conveyance speed of the sheet S passed through the fixing nip area N within a predetermined range with high accuracy.

In particularly, when the period other than the infrared light receiving period T3 when the light receiving unit 52 periodically receives the infrared light emitted from the light emitting unit 51 via the reflection member 21R is defined as the non-infrared light receiving period Toff, the light receiving unit 52 detects the temperature BT of the fixing belt 21 based on the receiving of the radiation light in the non-infrared light receiving period Toff in S5.

In the non-infrared light receiving period Toff, the radiation light radiated from the fixing belt 21 is received by the light receiving unit 52 while the infrared light emitted from the light emitting unit 51 is not received by the light receiving unit 52 via the reflection member 21R. Therefore, the light receiving unit 52 allows to detect the temperature of the fixing belt 21 correctly based on the amount of the received radiation light.

Especially, as shown in FIG. 7, when the light emitting unit 51 repeats the emitting of the infrared light and the stopping of the emitting at the predetermined period TL and the non-infrared light receiving period Toff contains the light emitting stop period T2 of the infrared light, because the emitting of the infrared light from the light emitting unit 51 is not carried out in the light emitting stop period T2, the light receiving unit 52 is prevented from erroneously detecting the infrared light owing to diffused reflection in the casing, for example. Accordingly, the light receiving unit 52 may preferably detect the temperature BT of the fixing belt 21 based on the receiving of the radiation light in the light emitting stop period T2 even in the non-infrared light receiving period Toff. In this case, the light receiving unit 52 allows to detect the temperature of the fixing belt 21 correctly based on the amount of the received radiation light.

Further, the storage part 60*c* previously stores the table showing the relationship between the temperature BT and the circumference L of the fixing belt 21. The drive control part 60*b* obtains the circumference L corresponding to a detected temperature BT of the fixing belt 21 by the light receiving unit 52 based on the above table (S7). By using the table in which the relationship is previously set, it becomes possible to obtain the circumference L corresponding to the temperature BT of the fixing belt 21 obtained in S5 easily.

Further, the drive control part 60*b* controls the drive unit 41 based on the rotational speed V of the fixing belt 21 obtained in S8 to adjust the rotational speed of the pressing roller 22, so that the conveyance speed of the sheet S passed through the fixing nip area N is kept within the predetermined range (S9). Even if the fixing belt 21 is heat-expanded and the circumference L is varied, the conveyance speed of the sheet S can be kept within the predetermined range by the adjustment of the rotational speed of the pressing roller 22, so that it becomes possible to achieve an excellent conveyance of the sheet S.

Further, the light receiving unit 52 is constituted of the infrared light sensor having sensitivity in both wavelength ranges for the infrared light emitted from the light emitting unit 51 and the radiation light radiated from the fixing belt 21. In this case, it becomes possible to detect both the infrared light and the radiation light using a single light receiving unit 52 (the infrared light sensor), so that it becomes possible to make the structure of the fixing device 13 simple compared with a case where the infrared light and the radiation light are detected by separate sensors.

Further, in the present embodiment, the fixing belt 21 is an example of a heated rotational body heated by the heating unit 23. Because the fixing belt 21 is easily changed in circumference depending on the temperature BT, an effect of the present embodiment is remarkably exhibited, in which the rotational speed V of the fixing belt 21 is correctly obtained and an adjustment of the rotational speed of the pressing roller 22 is carried out with high accuracy.

The image forming apparatus 100 of the present embodiment includes the fixing device 13 having the above-described structure and the image forming sections Pa to Pd which forms an unfixed toner image IM on the sheet S conveyed to the fixing device 13. Even if the fixing belt 21 is heat-expanded and the circumference L is changed, the pressing roller 22 is rotated based on the accurate rotational speed V of the fixing belt 21, so that the sheet S conveyed from the image forming sections Pa to Pd can be conveyed at the conveyance speed within the predetermined range and discharged from the fixing device 13.

The present disclosure is not limited to the configuration of the present embodiment, and various modifications can be made without departing from the spirit of the present disclosure. For example, in the present embodiment, the belt-heating type fixing device 13 provided with the endless fixing belt 21 as a rotational heated body is exemplified, but it is needless to say that the present invention can also be applied to a fixing device provided with a heated rotational body other than the fixing belt 21, such as a fixing roller. The heating unit 23 is not limited to an induction heating type including an excitation coil and a core, and a halogen heater, for example, may be used.

In this embodiment, an example in which the table showing the relationship in FIG. 5 is stored in the storage part 60*c* (see FIG. 4) of the control unit 60 is described, but the present disclosure is not limited to this embodiment. For example, a memory may be provided outside the control unit 60 in the fixing device 13, and the table may be stored in the memory. Further, a memory may be provided outside the fixing device 13 in the image forming apparatus 100, and the table may be stored in the memory. Further, the configuration may be such that the table is stored in a server (for example, a cloud server) outside the image forming apparatus 100, and the control unit 60 communicates with the server to refer to the table.

In the present embodiment, although the vertical conveyance type fixing device 13 in which the sheet S passes through the fixing nip area from the lower side to the upper side is described, the configuration described in the present embodiment can also be applied to a horizontal conveyance type fixing device in which the sheet S passes horizontally through the fixing nip area N.

The image forming apparatus 100 is not limited to a tandem type color printer as shown in FIG. 1, but can be applied to various image forming apparatuses equipped with a fixing device, such as a monochrome copying machine, a digital multifunctional peripheral, a facsimile, a laser printer, and the like.

INDUSTRIAL APPLICABILITY

The present disclosure can be used, for example, in a fixing device of an image forming apparatus such as a copying machine, a printer, a facsimile, and a multifunctional peripheral.

The invention claimed is:

1. A fixing device comprising:

a heated rotational body having a reflection member on a portion in a circumferential direction;

a heating unit which heats the heated rotational body;

a pressing rotational body coming into pressure contact with the heated rotational body, a fixing nip area where an unfixed toner image on a recording medium is melted and fixed being formed between the pressing rotational body and the heated rotational body;

a drive unit which rotates the pressing rotational body;

a light emitting unit which emits infrared light toward the heated rotational body;

a light receiving unit which receives the infrared light emitted from the light emitting unit and reflected on the reflection member of the heated rotational body periodically when the heated rotational body is rotated and receives radiation light generated by a heating of the heated rotational body; and a drive control part configured to control the drive unit based on a detection result of the light receiving unit, wherein the light receiving unit detects a temperature of the heated rotational body based on a receiving of the radiation light, the drive control part obtains a rotational speed of the heated rotational body based on a light receiving period of the infrared light in the light receiving unit and a circumference determined depending on the temperature of the heated rotational body, and controls the drive unit based on the obtained rotational speed, when a period other than a light receiving period of the infrared light when the light receiving unit periodically receives the infrared light emitted from the light emitting unit via the reflecting member is defined as a non-infrared light receiving period, and the light receiving unit detects the temperature of the heated rotational body based on the receiving of the radiation light in the non-infrared light receiving period.

2. The fixing device according to claim 1, wherein the light emitting unit repeats a light emitting of the infrared light and a stop of the light emitting at a predetermined period, the non-infrared light receiving period contains a light emitting stop period in which the light emitting unit stops the light emitting of the infrared light, and the light receiving unit detects the temperature of the heated rotational body based on the receiving of the radiation light in the light emitting stop period.

3. The fixing device according to claim 2, wherein the light emitting stop period is longer than a light emitting period of the infrared light.

4. The fixing device according to claim 2, wherein the light emitting unit controls a light emitting timing of the infrared light such that a period in which the infrared light reflected on the reflection member is received by the light receiving unit is contained in a light emitting period of the infrared light.

5. A fixing device comprising:

a heated rotational body having a reflection member on a portion in a circumferential direction;

a heating unit which heats the heated rotational body;

a pressing rotational body coming into pressure contact with the heated rotational body, a fixing nip area where an unfixed toner image on a recording medium is melted and fixed being formed between the pressing rotational body and the heated rotational body;

a drive unit which rotates the pressing rotational body;

a light emitting unit which emits infrared light toward the heated rotational body;

a light receiving unit which receives the infrared light emitted from the light emitting unit and reflected on the reflection member of the heated rotational body periodically when the heated rotational body is rotated and receives radiation light generated by a heating of the heated rotational body;

a drive control part configured to control the drive unit based on a detection result of the light receiving unit and a storage part configured to store a table showing a relationship between the temperature and the circumference of the heated rotational body, wherein the drive control part obtains the circumference of the heated rotational body depending on the temperature of the heated rotational body, based on the table, the light receiving unit detects a temperature of the heated rotational body based on a receiving of the radiation light, and the drive control part obtains a rotational speed of the heated rotational body based on a light receiving period of the infrared light in the light receiving unit and the circumference, and controls the drive unit based on the obtained rotational speed.

6. A fixing device comprising:

a heated rotational body having a reflection member on a portion in a circumferential direction;

a heating unit which heats the heated rotational body;

a pressing rotational body coming into pressure contact with the heated rotational body, a fixing nip area where an unfixed toner image on a recording medium is melted and fixed being formed between the pressing rotational body and the heated rotational body;

a drive unit which rotates the pressing rotational body;

a light emitting unit which emits infrared light toward the heated rotational body;

a light receiving unit which receives the infrared light emitted from the light emitting unit and reflected on the reflection member of the heated rotational body periodically when the heated rotational body is rotated and receives radiation light generated by a heating of the heated rotational body; and a drive control part configured to control the drive unit based on a detection result of the light receiving unit, wherein the light receiving unit detects a temperature of the heated rotational body based on a receiving of the radiation light, the drive control part obtains a rotational speed of the heated rotational body based on a light receiving period of the infrared light in the light receiving unit and a circumference determined depending on the temperature of the heated rotational body, and controls the drive unit based on the obtained rotational speed, and the drive control part controls the drive unit based on the rotational speed of the heated rotational body to adjust the rotational speed of the pressing rotational body, so that a conveyance speed of the recording medium passing through the fixing nip area is kept within a predetermined range.

7. The fixing device according to claim 1, wherein the light receiving unit is constituted of an infrared light sensor having sensitivity in both wavelength ranges of the infrared light and the radiation light.

8. The fixing device according to claim 1, wherein the heated rotational body is a fixing belt.

9. An image forming apparatus comprising:

the fixing device according to claim 1; and an image forming unit for forming the unfixed toner image on the recording medium to be conveyed to the fixing device.

* * * * *